US006021768A

United States Patent [19]

Pomaville

[11] Patent Number: 6,021,768

[45] Date of Patent: Feb. 8, 2000

[54] ARCHER'S BOW REST

[76] Inventor: Louis F. Pomaville, 4030 Chilton St., Muskegon, Mich. 49441

[21] Appl. No.: 09/301,201

[22] Filed: Apr. 28, 1999

[51] Int. Cl.[7] ..... F41B 5/14

[52] U.S. Cl. ..... 124/1; 124/86; 182/187

[58] Field of Search ..... 124/1, 23.1, 86; 182/187

[56] References Cited

U.S. PATENT DOCUMENTS

| | | | |
|---|---|---|---|
| 3,168,971 | 2/1965 | Goertzen | 124/23.1 X |
| 3,856,111 | 12/1974 | Baker | 182/135 |
| 4,103,807 | 8/1978 | Lyon et al. . | |
| 4,236,602 | 12/1980 | Leggett | 182/187 |
| 4,582,165 | 4/1986 | Latini | 182/20 |
| 4,621,752 | 11/1986 | Youngbauer | 224/253 |
| 4,683,672 | 8/1987 | Davis . | |
| 4,729,363 | 3/1988 | Skyba . | |
| 4,936,415 | 6/1990 | Williams | 124/23.1 X |
| 4,987,972 | 1/1991 | Helms | 182/187 |
| 5,111,800 | 5/1992 | Reynolds | 124/88 |
| 5,186,276 | 2/1993 | Craig | 124/23.1 X |
| 5,265,780 | 11/1993 | Matthews et al. . | |
| 5,310,019 | 5/1994 | Paul | 182/187 |
| 5,465,933 | 11/1995 | Todd | 248/201 |
| 5,628,383 | 5/1997 | McIntyre | 182/187 |
| 5,680,910 | 10/1997 | Sarphie, IV | 182/135 |

*Primary Examiner*—John A. Ricci
*Attorney, Agent, or Firm*—Waters & Morse, P.C.

[57] ABSTRACT

An archer's bow rest is used with a support structure and supports an archer's bow. The bow rest includes a cup member and a brace. More particularly, the cup member is connected with the support structure and defines a recess that is adapted to removably receive an end of the archer's bow. In one aspect, the cup member further includes a generally J-shaped member and a ring member. The J-shaped member has a first leg, a bite portion, and a second leg, with the first and second legs extending in the same general direction from the bite portion. In another aspect, the ring member is connected with each of the first and second legs, whereby the ring member, the first leg, the bite portion, and at least a portion of the second leg define the recess. At least one of the ring member and the J-shaped member may be constructed of an elongated pliable member. Further, at least a portion of the second leg may be an elongated pliable member that extends from the ring member to a terminal end, with the terminal end being connected with the support structure. The brace may further include cooperating first and second releasable coupler members. The first coupler member may be connected with the support structure, while the second coupler member is connected with the bow. The first and second coupler members have coupled and released conditions, with the first and second coupler members resisting a separating force when in the coupled condition, and the first and second coupler members becoming uncoupled in the released condition when the separating force is substantially removed. In a further aspect, the first coupler member may further include an elongated pliable member that is connected with the support structure and extends to a terminal end. The terminal end couples with the second coupler member. In yet another aspect, one of the first and second coupler members has a hook portion, and the other of the first and second coupler members has a loop portion. Further, the hook portion and loop portion engage in the coupled condition.

24 Claims, 5 Drawing Sheets

ARCHER'S BOW REST

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to archery accessories, and more particularly to a bow rest.

Particularly in the setting of bow hunting, and especially when hunting from a stand, an archer will spend extended periods of time merely waiting for an opportunity to draw and shoot an arrow. Such waiting is commonly tedious and wearisome. More specifically, hunting is typically done in cold weather so one's hands may get very cold while holding a bow. Further, merely the act of holding a bow for long periods of time will result in fatigue, which will reduce the accuracy of a shot when the opportunity does arise.

Because of the nature of a bow, and particularly the construction of compound bows, simply laying a bow on the ground or standing a bow on end and leaning it against some structure is damaging to the bow. Also, a bow hunter will want the bow to be readily at hand with minimal commotion. Thus, one will readily realize the desirability of a bow rest that protects the bow and holds the bow close at hand without requiring the archer to hold the bow, so the archer may keep his hands warm and will not be fatigued by holding the bow.

BRIEF SUMMARY OF THE INVENTION

Accordingly, an archer's bow rest of the invention is used with a support structure and supports an archer's bow. The bow rest includes a cup member, a brace, and a receiver. More particularly, the cup member is connected with the support structure and defines a recess that is adapted to removably receive an end of the archer's bow.

In one aspect of the invention, the cup member further includes a generally J-shaped member and a ring member. The J-shaped member has a first leg, a bite portion, and a second leg, with the first and second legs extending in the same general direction from the bite portion. In another aspect of the invention, the ring member is connected with each of the first and second legs, whereby the ring member, the first leg, the bite portion, and at least a portion of the second leg define the recess. At least one of the ring member and the J-shaped member may be constructed of an elongated pliable member. Further, at least a portion of the second leg may be an elongated pliable member that extends from the ring member to a terminal end, with the terminal end being connected with the support structure.

The brace may further include cooperating first and second releasable coupler members. The first coupler member may be connected with the support structure, while the second coupler member is connected with the bow. The first and second coupler members have coupled and released conditions, with the first and second coupler members resisting a separating force when in the coupled condition, and the first and second coupler members becoming uncoupled in the released condition when the separating force is substantially removed.

In one aspect of the invention, the first coupler member may further include an elongated pliable member that is connected with the support structure and extends to a terminal end. The terminal end couples with the second coupler member. In another aspect of the invention, one of the first and second coupler members has a hook portion, and the other of the first and second coupler members has a loop portion. Further, the hook portion and loop portion engage in the coupled condition.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
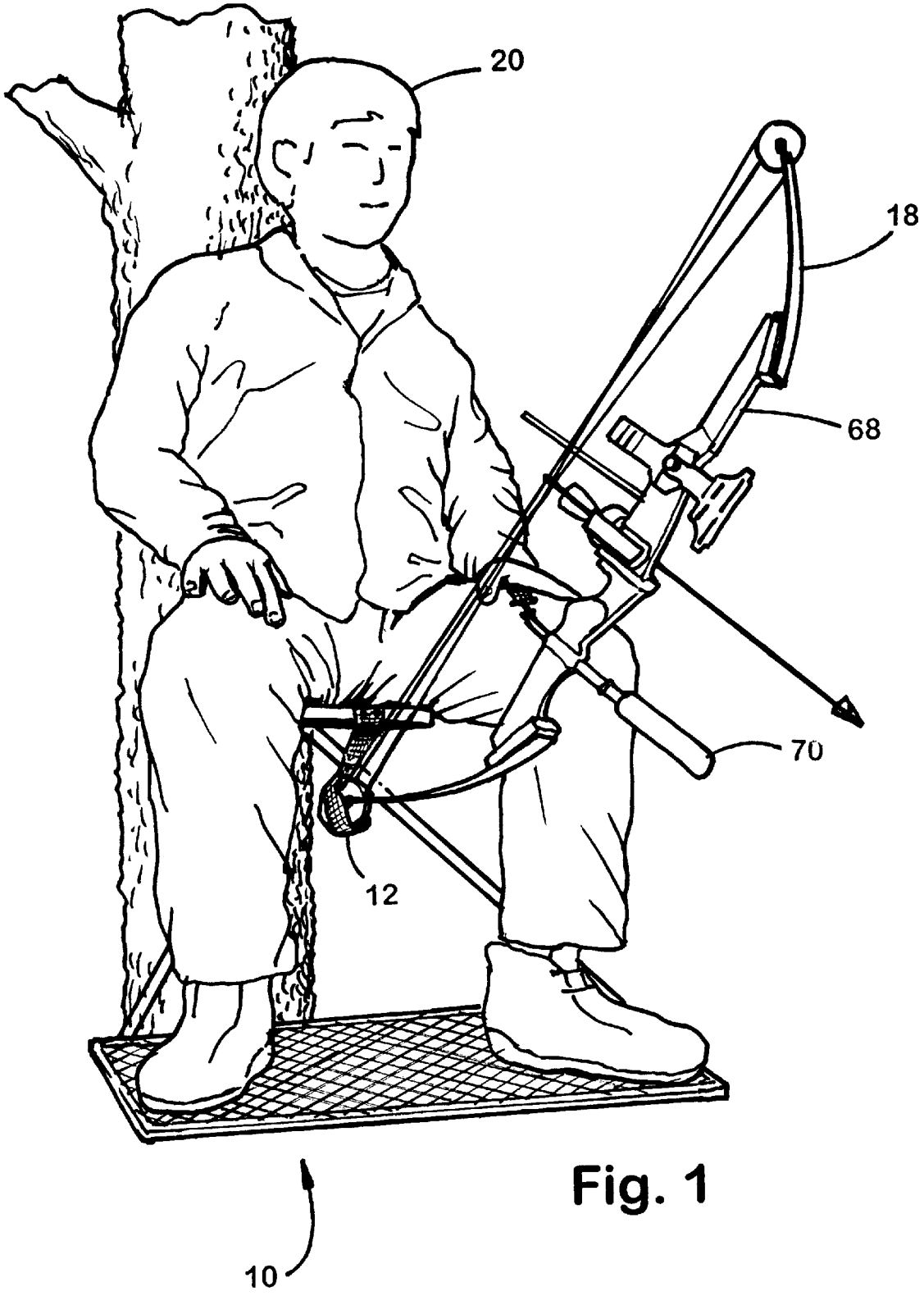
FIG. 1 is perspective view showing an archer's bow rest according to the invention as used by an archer in a tree stand.
Figure 2:
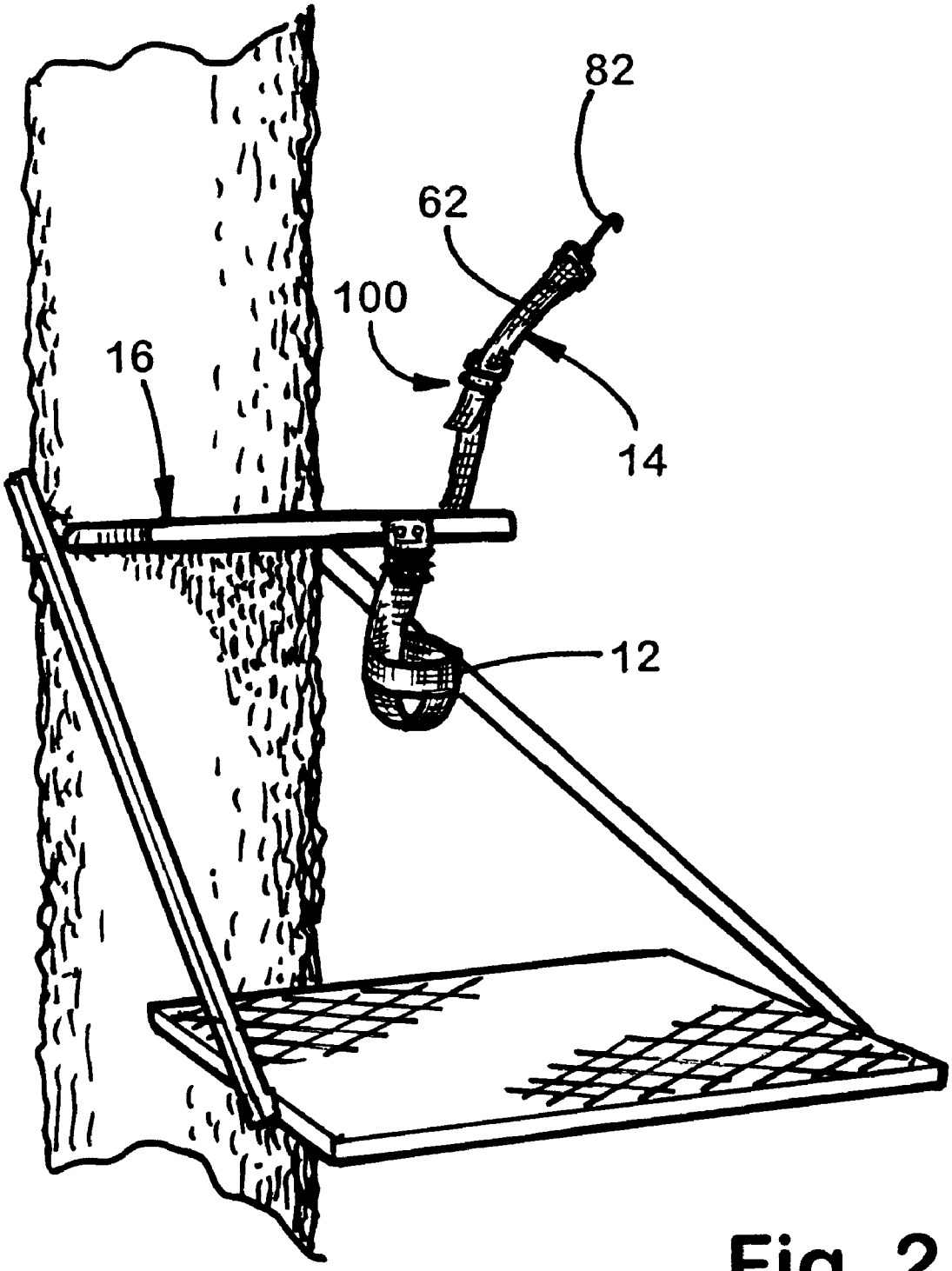
FIG. 2 is the view of FIG. 1 with the archer and bow removed.
Figure 3:
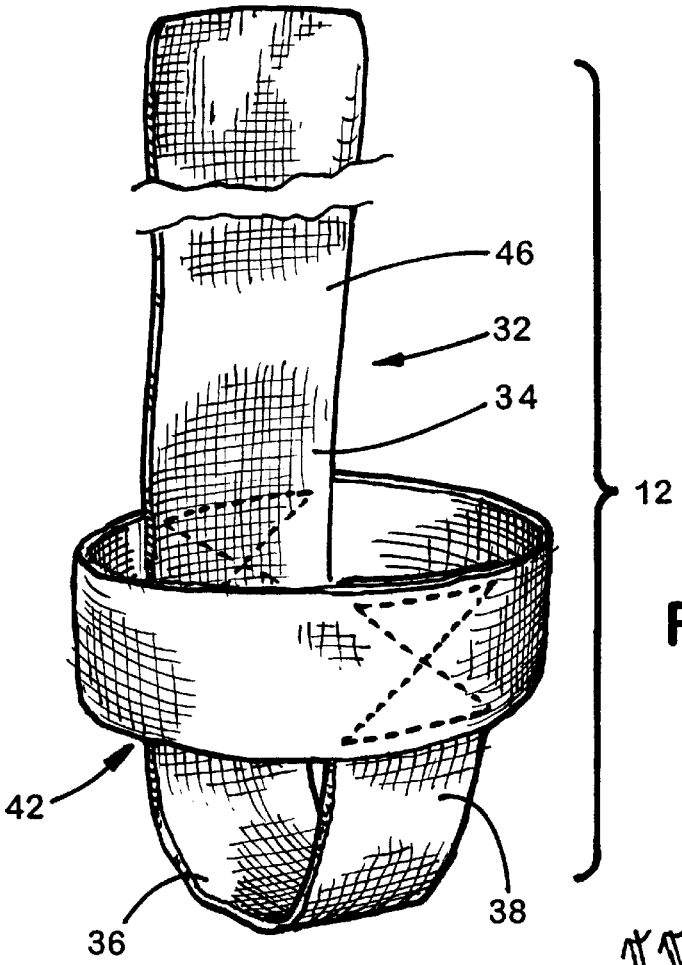
FIG. 3 is a fragmentary perspective view of a cup member of the archer's bow rest.
Figure 4:
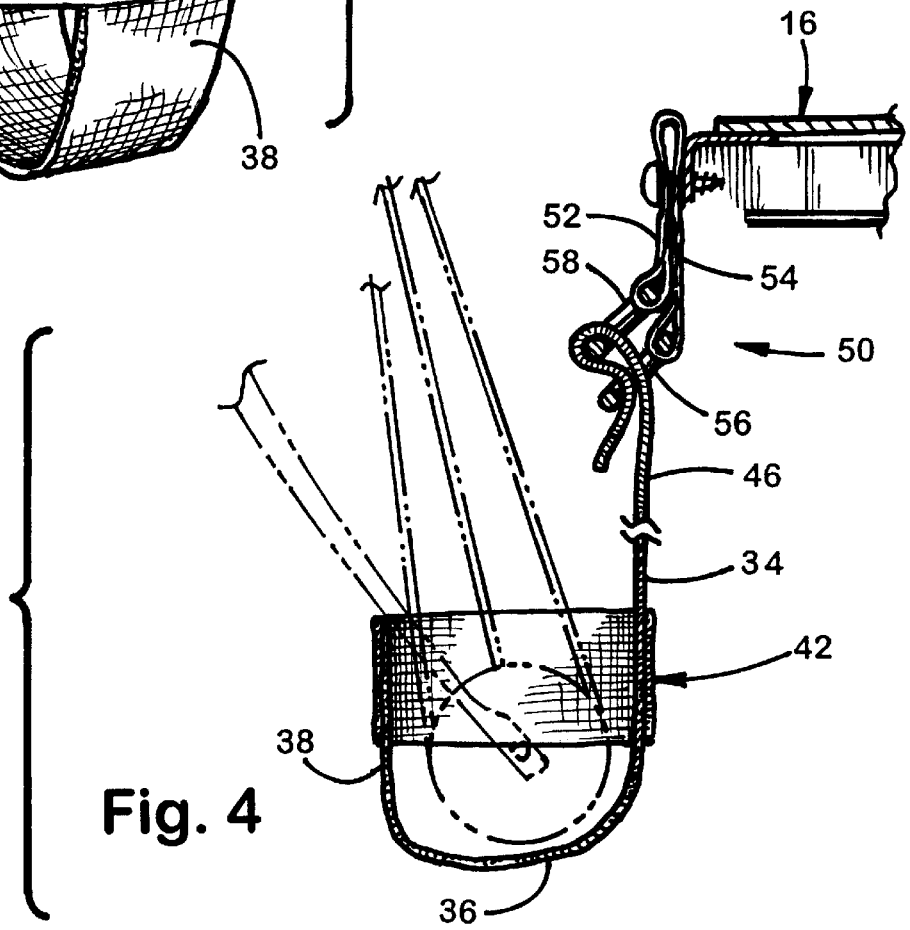
FIG. 4 is a cross-sectional view thereof, cut along line IV—IV of FIG. 3.

An archer's bow rest 10 according to the invention is generally shown in the drawing FIGS. 1–5 and includes a cup or pocket member 12 and a brace 14, each of which is connected with a support structure 16 to support an archer's bow 18 for ready use by the archer 20, without requiring the archer to hold on to the bow.

The cup 12 is provided with a recess that is adapted to removably receive an end of the archer's bow 18. A connector that connects the cup or pocket 12 with the support structure 16 is also provided and will be described in greater detail below. Most preferably, the pocket 12 is constructed of two strips of a pliable material. The inventor notes that a fabric webbing, nylon for example, that is about 1½ to 2 inches (3–5 mm) wide works well for the two strips of pliable material that make up the pocket or cup member 12. One having ordinary skill in the art will understand, however, that numerous alternative materials may be used, including metal, wood, and plastic, for example.

A first strip is formed into a generally J-shaped member 32 that has a first leg 34, a bite portion 36, and a second leg 38. The first and second legs 34 and 38, respectively, extend in the same general direction from the bite portion 36. The second strip is formed into a ring member 42 that is connected with each of the first and second legs 34 and 38 respectively. More particularly, the second leg 38 extends from the bite portion 36 to a terminal end and the ring 42 is connected at the terminal end of the second leg. A corresponding and opposing connection is also made between the ring member 42 and the first leg 34. Thus, the pocket or cup member is a holder that defines a recess.

The first leg 34 preferably extends beyond the ring member 42 to a terminal end, and provides a strap portion 46 to connect the pocket 12 with the support structure 16. As is specifically shown in the drawing figures, the support structure 16 is most preferably an archer's seat as found in a conventional hunter's tree stand, for example. One having ordinary skill in the art will realize that alternative support structure configurations will work equally well.

A strap and double ring adjustment mechanism 50 as is commonly known and referred to as a double ring buckle, provides convenient and adjustable connection of the pocket 12 with the support structure 16. More specifically, first and second brackets 52 and 54 respectively, may be screw fastened, or the like, to a front edge of the seat 16 as shown (FIGS. 1, 2, 4, and 5). The brackets 52 and 54, respectively, hold the two rings 56 and 58, respectively, of the double ring buckle 50 so the rings pivot or swing apart from and toward each other. The brackets 52 and 54, respectively, may be constructed of any suitable material, including metal, plastic, or nylon webbing, for example, as will be known to one having ordinary skill in the art.

To keep a loose end of the strap portion 46 from tangling in the bottom end of the bow, in the pocket 12, the strap portion 46 is most preferably threaded in a generally downward and back direction through the first and second rings 56 and 58, respectively (FIG. 4), in a first direction, around the outside of the second ring 58, and back through the first ring 56 in a direction generally opposite the first direction. With the strap portion 46 so threaded through the double rings 56 and 58 respectively, pulling on the strap portion will cinch the rings together and hold the pocket 12 in a preselected position relative to the seat 16. The position of the pocket is adjusted by sliding the strap through the double rings, as is well known.

The brace 14 extends between the support structure 16 and the bow 18, and includes two brace or coupler members. One of the brace or coupler members is a receiver 64 that is attached to the bow 18 and preferably to the bow riser 68. The receiver 64 may be a formed wire member as is specifically shown (FIGS. 6–8), or may be a molded member, for example. One having ordinary skill in the art will understand that the receiver 64 may have a variety of constructions, employing various suitable materials.

However the receiver 64 is fabricated, it is preferably made to attach to the bow and have one side of a releasable fastener. Again, as specifically shown, the receiver 64 may be a member that has a length of about three inches (76 mm) and is constructed of ten gauge stainless steel wire. A loop 96 (FIGS. 6–8) is formed at one end of the receiver 64 for screw attachment to the bow. A cooperating screw member may be inserted through the loop 96 to screw the loop to the bow. An inner diameter of the loop 96 is preferably larger than about 5/16 inch (8 mm) to receive the industry standard 5/16 diameter threaded shaft of the stabilized 70. From the attachment loop 96, the receiver 64 has shaft portion that extends generally perpendicularly from the loop 96 to a second loop 98. The second loop 98 is angled at about forty-five degrees to the attachment loop 96 and the shaft portion. Further, the second loop 98 defines the one side of a releasable fastener as will be discussed further below. The size of the loop 96 has not been found to be critical and a range of about ½ to ¾ inch (12–20 mm) diameter has been found to work well.

Figure 6:
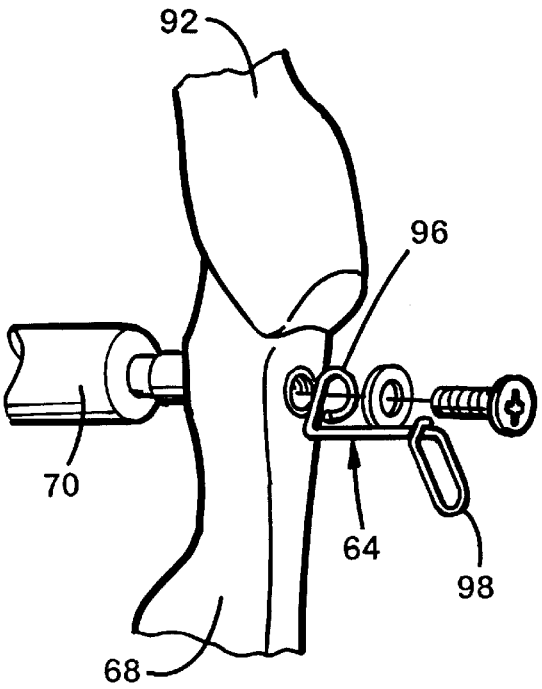
FIG. 6 is an exploded fragmentary perspective view of a coupler of the archer's bow rest, showing a first installation with a bow riser.
Figure 7:
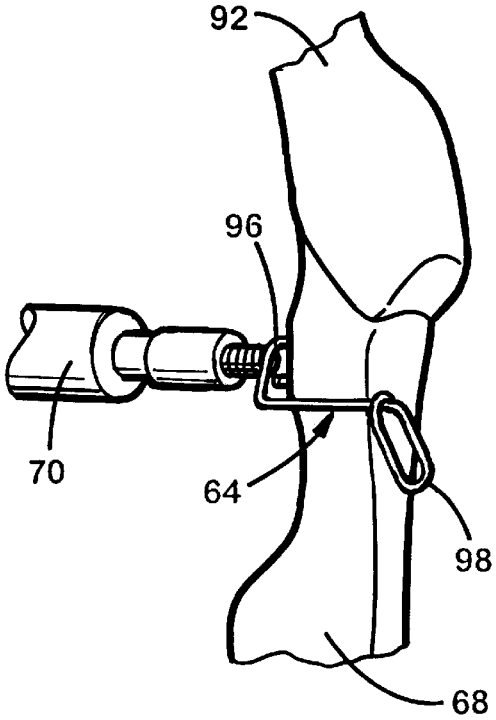
FIG. 7 is the view of FIG. 6, showing an alternative second installation of the coupler with the bow riser.
Figure 8:
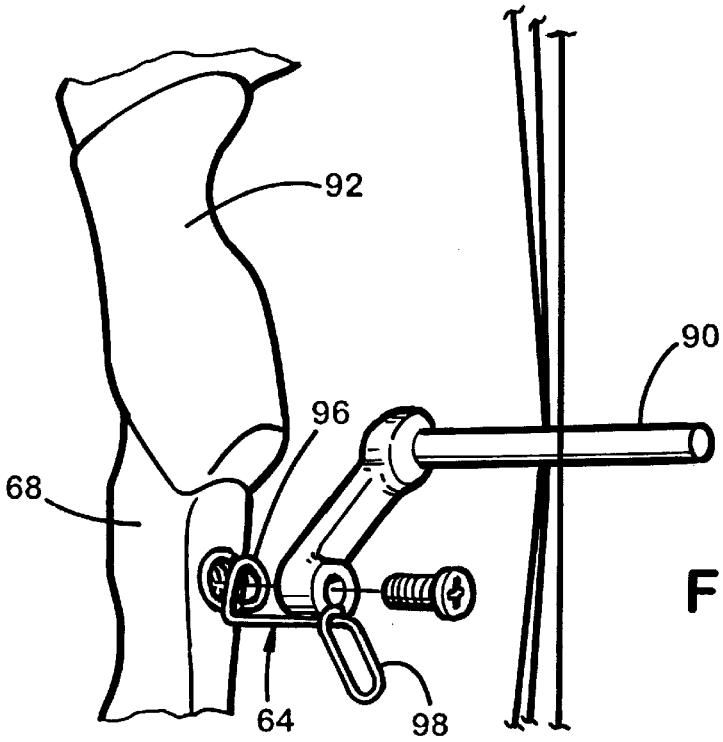
FIG. 8 is the view of FIG. 6, showing an alternative third installation of the coupler with the bow riser.

Contemporary bows, especially compound bows, are commonly provided with shooting stabilizers 70. The typical method of attaching the stabilizer 70 is to provide the bow riser 68 with a threaded insert in a front of the riser, whereby the stabilizer is screw attached at the front of the bow riser 68. The threaded insert may continue to extend through a back of the riser as shown in FIG. 6. This situation also provides screw thread attachment for the receiver 64 at the back of the bow riser 68 (FIG. 6) with an appropriately sized and threaded screw. Alternatively, the receiver 64 may be installed with the stabilizer 70 at the front of the bow riser 68 as is shown in FIG. 7. Contemporary compound bows are also typically provided with a cable guard 90. Thus, in a further alternative, the receiver 64 may be installed with a cable guard 90 (FIG. 8). It is noted that most compound bows have a cable guard 90 that extends from the back of the riser 68 and is positioned below the arrow rest, as shown in FIG. 8. Some more recent vintage bows position the cable guard above the arrow rest, however. These recent vintage bows commonly have a threaded hole completely through the riser 68, as shown in FIG. 6, however. It is further noted that bows typically have at least a stabilizer mount located below the hand grip, as in FIG. 7. Thus, the receiver 64 can be installed on any compound bow riser 68.

Figure 9:
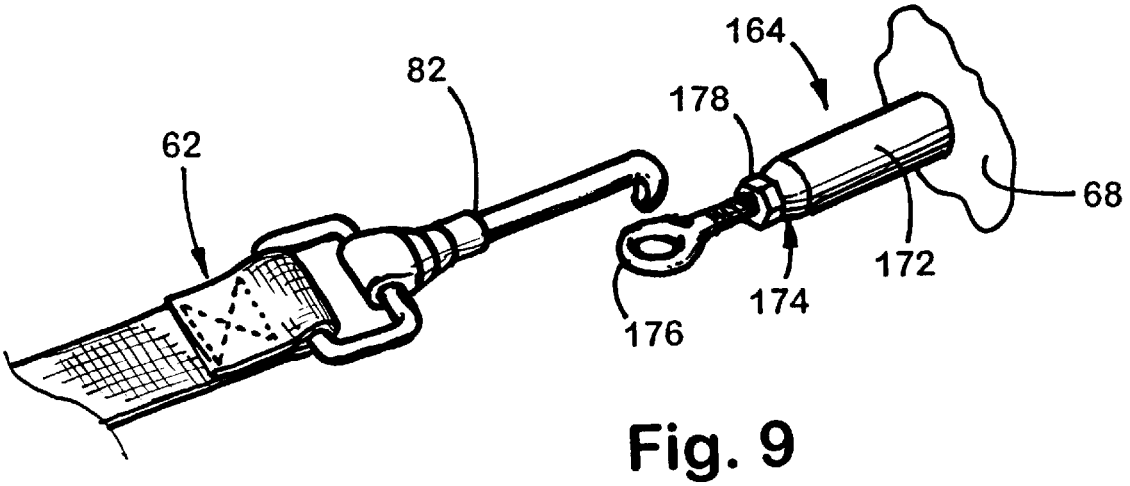
FIG. 9 is an exploded fragmentary perspective view of an alternative coupler of the archer's bow rest.
Figure 5:
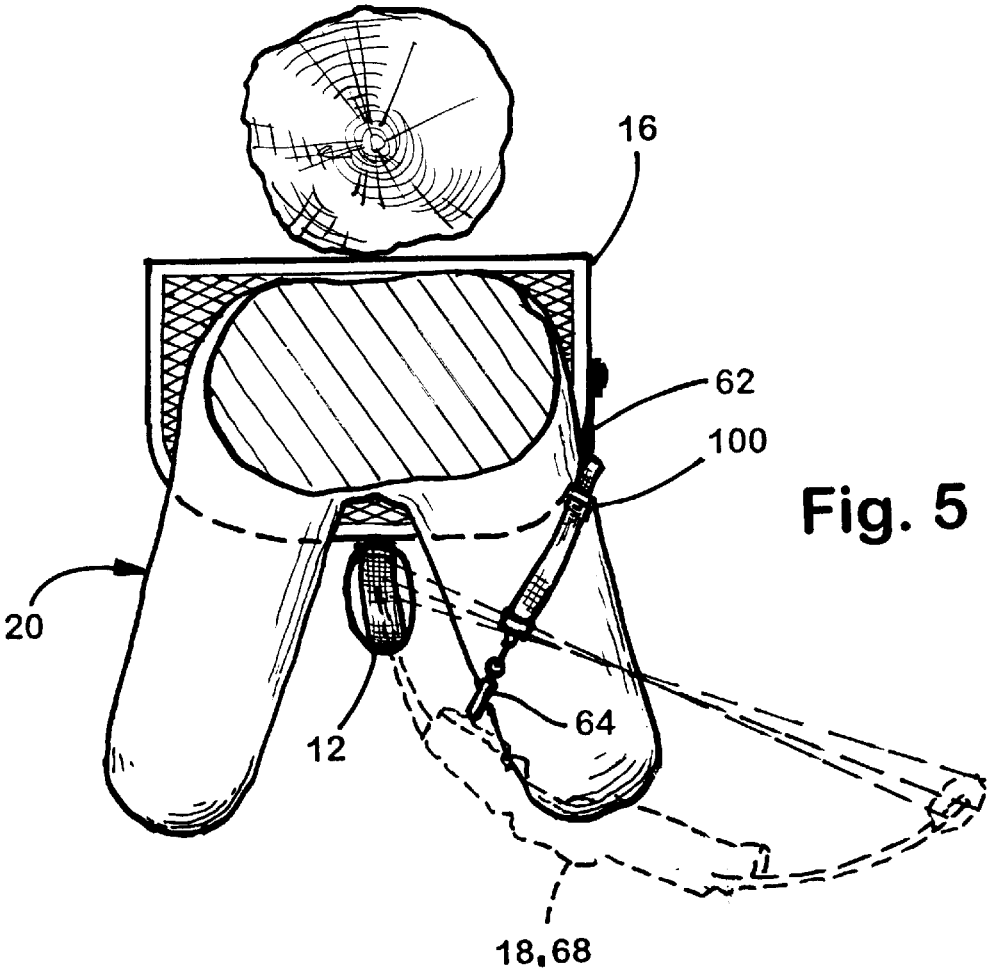
FIG. 5 is a downward looking view of the arrangement of FIG. 1.

By way of example, one alternative receiver 164 is shown in drawing FIG. 9 to demonstrate that the receiver may successfully be fabricated with a variety of configurations. More specifically, the receiver 164 includes an extension post 172 that screw fastens with the threaded insert of the riser 68. The receiver 164 may extend about two to three inches (51 to 76 mm) from the riser over all. Internal screw threads are provided at a terminal end 174 of the extension post 172, and a screw eye 176 is threaded into the extension post 172. This allows rotation and alignment of the loop of the screw eye as desired by a user. A locking or jam nut 78 is screw threaded onto the screw eye 76 to secure the adjusted orientation of the screw eye. This arrangement also provides a length adjustment of the receiver 164.

The other brace or coupler member 62 is an elongated member of a pliable material that extends from the support structure 16 to a terminal end. A fabric webbing is again preferred. Although a length of cord or the like will work satisfactorily, the narrow face of a cord can be uncomfortable to the user. A webbing will present a broader or larger contact area against the user as will be understood from the discussion of use of the invention, further below. More specifically, the coupler member 62 is most preferably constructed of two lengths of a one inch (25 mm) webbing, that are interconnected with a slip adjustable double ring buckle 100, as is commonly known by one having ordinary skill in the art. Thus, the brace member 62 is length adjustable to accommodate various users.

A releasable coupler 82 is provided at the terminal end of the coupler member 62. The coupler 82 may be a truncated hook member, whereby the coupler 82 cooperates with the loop 98 of the receiver 64 to couple the two members 62 and 64 together and resist a separating force. Conversely, the two coupler members 62 and 64 become uncoupled when the separating force is substantially removed. The shallow open J-hook of coupler 82 merely falls away from the loop 98.

In use, the pocket or cup member 12 is connected with the support 16 as discussed above. The brace 14 is also connected with the support 16 with a common screw fastener, for example, and is preferably connected to extend from a side of the seat. With the archer 20 sitting on the seat 16, a lower end of the bow 18 is placed in the pocket 12. The brace 14 is brought diagonally over the user's leg with the coupler or hook 82 lying on the user's leg with the J-hook extending generally upward, away from the user's leg. The coupler 82 is mated with the loop 98. The bow is moved to apply a separating force to the brace members 62 and 64, which keeps the coupler 82 and the loop 98 in coupled engagement. With the bow seated in the cup 12 and the brace 14 connected, the bow is rested against the user's leg and may be released. Thus, the bow is held readily at hand, preferably with the grip 92 accessible above the archer's knee. When the archer grasps the bow and moves it toward himself to pick up the bow, the separating force that was applied to the brace members 62 and 64 will be removed and the hook 82 will fall away from the loop 98.

Depending upon the physiology of the user 20, the geometry of the bow 18, and the geometry of the support structure 16, the specific positioning of the bow relative to the user is adjusted by vertically adjusting the cup 12 and the length of brace 14.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

I claim:

1. An archer's bow rest that is used with a support structure and supports an archer's bow, the bow rest comprising:

a cup member that defines a recess, the cup member being connected with the support structure, the recess being adapted to removably receive an end of the archer's bow; and cooperating first and second releasable coupler members, the first coupler member being connected with the support structure, the second coupler member being connected with the bow, the first and second coupler members having coupled and released conditions, the first and second coupler members resisting a separating force when in the coupled condition, the first and second coupler members becoming uncoupled in the released condition when the separating force is removed.

2. The archer's bow rest that is defined in claim 1, wherein the first coupler member further includes an elongated pliable member that is connected with the support structure and extends to a terminal end, the terminal end coupling with the second coupler member.

3. The archer's bow rest that is defined in claim 2, wherein one of the first and second coupler members has a hook portion, wherein the other of the first and second coupler members has a loop portion, and wherein the hook portion and loop portion engage in the coupled condition.

4. The archer's bow rest that is defined in claim 3, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

5. The archer's bow rest that is defined in claim 4, wherein at least one of the ring member and the J-shaped member is constructed of an elongated pliable member.

6. The archer's bow rest that is defined in claim 5, wherein at least a portion of the second leg is an elongated pliable member that extends from the ring member to a terminal end, the terminal end being connected with the support structure.

7. The archer's bow rest that is defined in claim 1, wherein one of the first and second coupler members has a hook portion, wherein the other of the first and second coupler members has a loop portion, and wherein the hook portion and loop portion engage in the coupled condition.

8. The archer's bow rest that is defined in claim 1, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

9. An archer's bow rest that is used with a support structure and supports an archer's bow the bow rest comprising:

a pocket, the pocket being adapted to removably receive an end of the archer's bow;

a connector, the connector being connected with the pocket and being adapted to connect the pocket with the support structure;

a receiver, the receiver being connected with the archer's bow; and a brace, the brace releasably coupling with the receiver and further being adapted to connect with the support structure, whereby the end of the archer's bow is removably placed in the pocket and the brace is releasably coupled with the receiver so the archer's bow is held.

10. The archer's bow rest that is defined in claim 9, wherein the brace further includes an elongated pliable member that is connected with the support structure and extends to a terminal end, the terminal end coupling with the receiver.

11. The archer's bow rest that is defined in claim 10, wherein one of the brace or receiver has a hook portion, wherein the other of the brace or receiver has a loop portion, and wherein the hook portion and loop portion engage in the coupled condition.

12. The archer's bow rest that is defined in claim 11, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

13. The archer's bow rest that is defined in claim 12, wherein at least one of the ring member and the J-shaped member is constructed of an elongated pliable member.

14. The archer's bow rest that is defined in claim 13, wherein at least a portion of the second leg is an elongated pliable member that extends from the ring member to a terminal end, the terminal end being connected with the support structure.

15. The archer's bow rest that is defined in claim 9, wherein one of the brace or receiver has a hook portion, wherein the other of the brace or receiver has a loop portion, and wherein the hook portion and loop portion engage in the coupled condition.

16. The archer's bow rest that is defined in claim 9, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

17. An archer's bow rest that is used with a support structure and supports an archer's bow, the bow rest comprising:

a pocket, the pocket being adapted to removably receive an end of the archer's bow, the pocket further being adapted to connect with a support structure; and a brace, the brace having a first brace member that is connected with the archer's bow, the brace having a cooperating second brace member that releasably couples with the first brace member, the second brace member further being adapted to connect with a support structure, whereby the end of the archer's bow is removably placed in the recess and the brace releasably couples the receiver with a support structure so the archer's bow is held.

18. The archer's bow rest that is defined in claim 17, wherein the second brace member further includes an elongated pliable member that is connected with the support structure and extends to a terminal end, the terminal end coupling with the first brace member.

19. The archer's bow rest that is defined in claim 18, wherein one of the first and second brace members has a hook portion, wherein the other of the first and second brace members has a loop portion, and wherein the hook portion and loop portion engage in the coupled condition.

20. The archer's bow rest that is defined in claim 19, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

21. The archer's bow rest that is defined in claim 20, wherein at least one of the ring member and the J-shaped member is constructed of an elongated pliable member.

22. The archer's bow rest that is defined in claim 21, wherein at least a portion of the second leg is an elongated pliable member that extends from the ring member to a terminal end, the terminal end being connected with the support structure.

23. The archer's bow rest that is defined in claim 17, wherein one of the first and second brace members has a hook portion, wherein the other of the first and second brace members has a loop portion, and wherein the hook portion and loop portion engage in the coupled condition.

24. The archer's bow rest that is defined in claim 17, wherein the cup member further includes a generally J-shaped member that has a first leg, a bite portion, and a second leg, the first and second legs extending in the same general direction from the bite portion, and wherein the cup member further includes a ring member, the ring member being connected with each of the first and second legs, whereby the ring member, the first leg, the bite portion, and at least a portion of the second leg define the recess.

* * * * *